US007339449B2

(12) United States Patent
Hansen

(10) Patent No.: US 7,339,449 B2
(45) Date of Patent: Mar. 4, 2008

(54) MAGNETIC WOVEN HEART

(76) Inventor: Jack Henrik Hansen, 76 Hewitt Rd., North Stonington, CT (US) 06359

( * ) Notice: Subject to any disclaimer, the term of this patent is extended or adjusted under 35 U.S.C. 154(b) by 331 days.

(21) Appl. No.: 11/224,611

(22) Filed: Sep. 12, 2005

(65) Prior Publication Data

US 2007/0056651 A1 Mar. 15, 2007

(51) Int. Cl.
*H01F 7/02* (2006.01)
*G09F 7/04* (2006.01)

(52) U.S. Cl. ..... 335/306; 335/302; 40/600

(58) Field of Classification Search ..... 335/302–306; 40/600

See application file for complete search history.

(56) References Cited

U.S. PATENT DOCUMENTS

2004/0231212 A1* 11/2004 Roche ..... 40/600

OTHER PUBLICATIONS http://users.cybercity.dk The Woven Paper Heart for Christmas & Valentine's Day, 5 pages.

* cited by examiner

*Primary Examiner*—Ramon M. Barrera
(74) *Attorney, Agent, or Firm*—Nicole E. Coppes-Gathy

(57) ABSTRACT

A woven magnetic is disclosed. The woven magnetic device comprises a first member comprising a magnetic material and having a body with a top portion and a bottom portion opposite the top portion and the bottom portion has at least two fingers. The woven magnetic device also comprises a second member comprising a magnetic material and having a body with a top portion and a bottom portion opposite the top portion. The bottom portion has at least two fingers interwoven with the at least two fingers of the first member.

17 Claims, 9 Drawing Sheets

MAGNETIC WOVEN HEART

BACKGROUND

A unique Scandinavian tradition is the creation of baskets for hanging on a Christmas tree. These baskets were created of paper that was cut and woven together to form a basket in which treats could be stored. The paper baskets were generally in the shape of hearts. The heart shaped baskets symbolized the love and beauty of Christmas while displaying an individuals' artistic flair.

For years, people have been displaying bumper stickers and other emblems on their vehicles (or other foreign objects) to show their support for a cause, support a candidate running for office, or to say something funny. However, once the bumper stickers have been applied to the surface of the object, they are difficult to remove. In some cases, the stickers have ruined the surface of the object to which they are applied.

What is needed in the art is a device that is easily removable from a surface, without ruining the surface, while still conveying an individual's viewpoint.

SUMMARY

The disclosure is directed toward a woven magnetic device. The woven magnetic device comprises a first member having a body with a top portion and a bottom portion opposite the top portion and the bottom portion has at least two fingers. The woven magnetic device also comprises a second member having a body with a top portion and a bottom portion opposite the top portion. The bottom portion has at least two fingers interwoven with the at least two fingers of the first member. The first member and the second member comprise a magnetic material.

The disclosure is also directed toward a method for making a woven magnetic device. The method comprises producing a first member having a body with a top portion and a bottom portion opposite the top portion and the bottom portion has at least two fingers. The method also comprises weaving at least two fingers of a second member with the at least two fingers of the first member. The second member has a body with a top portion and a bottom portion opposite the top portion and the bottom portion has the at least two fingers. The first member and the second member comprise a magnetic material.

BRIEF DESCRIPTION OF THE FIGURES

Referring now to the figures, wherein like elements are numbered alike.

DETAILED DESCRIPTION

Persons of ordinary skill in the art will realize that the following disclosure is illustrative only and not in any way limiting. Other embodiments of the invention will readily suggest themselves to such skilled persons having the benefit of this disclosure.

The present invention is a woven magnetic device that has an overall shape of a heart. The woven magnetic device adheres to metal objects and is removable. The woven magnetic device does not require additional adhesives to create the overall effect, since the magnetic material adheres to itself. The woven magnetic device can be displayed alone or can display support for a cause or convey a belief. The weaving of the magnetic material provides a three dimensional appearance to the woven magnetic device, which is desirable to an individual looking to make a statement.

Figure 1:
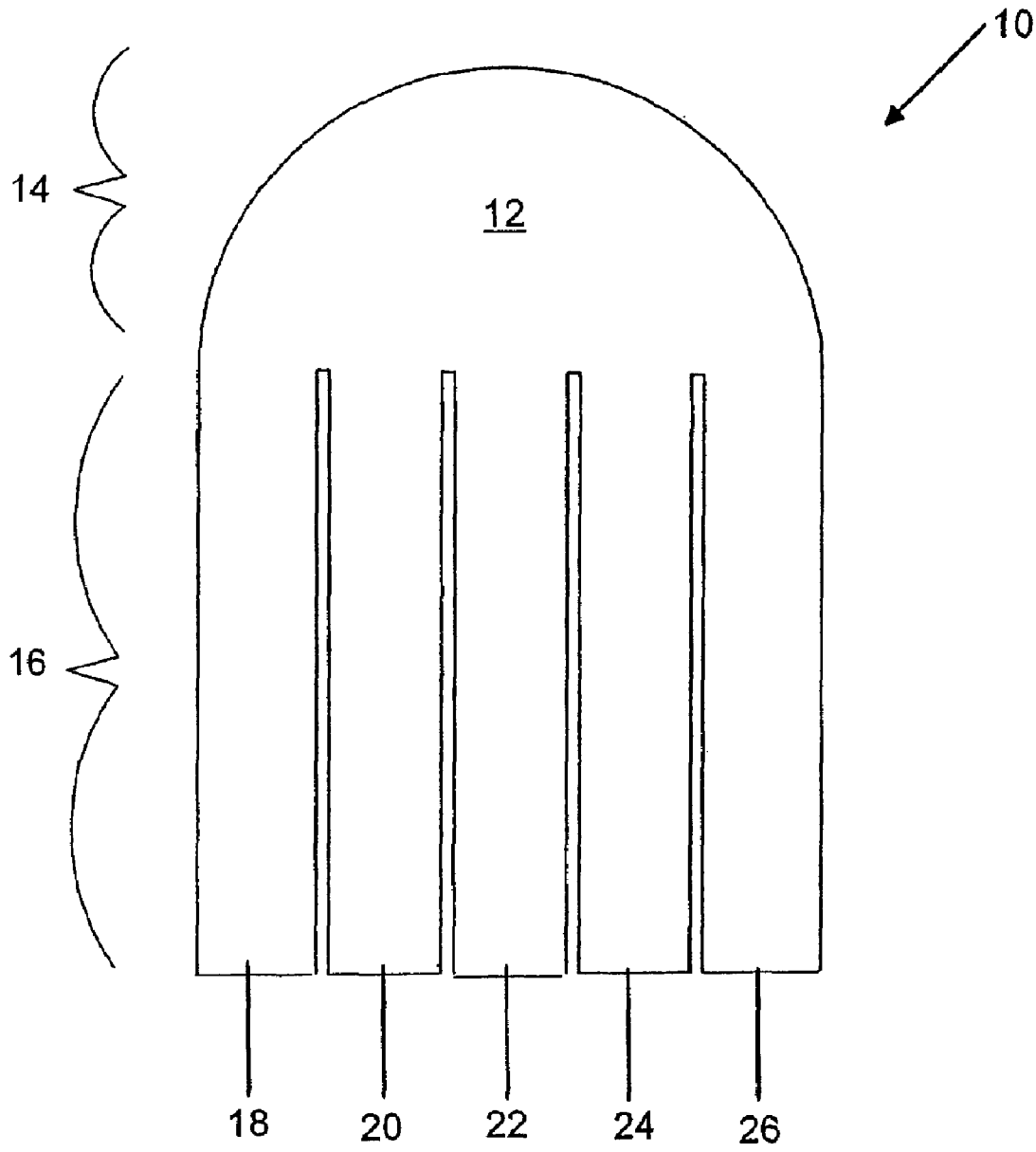
FIG. 1 is a perspective view of a first member of an exemplary woven magnetic device.

A preferred embodiment is illustrated in FIG. 1. A first member 10 includes a body 12. The first member 10 body 12 has a top portion 14 and a bottom portion 16. The top portion 14 can be of any shape, with a rounded configuration preferred, although other configurations are contemplated, as illustrated and further described in FIG. 8. The bottom portion 16 is configured to have fingers 18, 20, 22, 24, 26. The fingers are of equal length. Although five fingers are illustrated, any number of fingers may be utilized depending upon the intricacies of the design desired.

Figure 2:
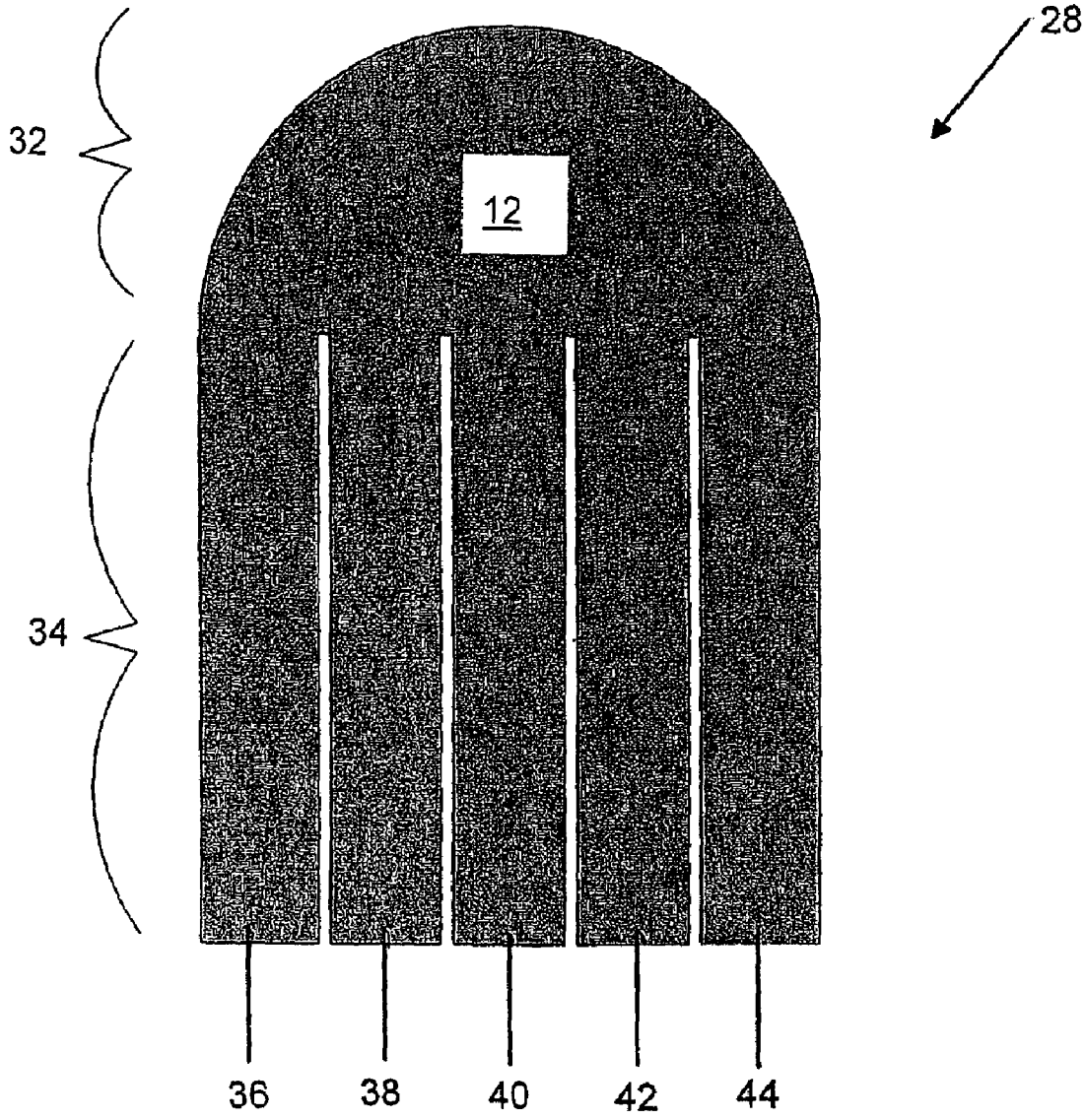
FIG. 2 is a perspective view of a second member of an exemplary woven magnetic device.

Referring now to FIG. 2, a second member 28 is illustrated. The second member 28 includes a body 30. The second member 28 body 30 has a top portion 32 and a bottom portion 34. The top portion 32 can be of any shape, with a rounded configuration preferred, although other configurations are contemplated, as illustrated and further described in FIG. 8. The bottom portion 34 is configured to have fingers 36, 38, 40, 42, 44. The fingers are of equal length and shape. Although five fingers are illustrated, any number of fingers may be utilized depending upon the intricacies of the design desired. In each case, when weaving, the two members 10, 28 should be the same, having an equal number, shape and length of fingers. The shape of the members and fingers may vary depending upon the design or pattern desired, as will be discussed further herein. It is also preferable for the first member 10 and the second member 28 to be two different colors, although one or any number of colors can be utilized, as will be discussed further herein.

It is also contemplated to cut the fingers on an angle (i.e., 45 degrees) to enhance the effect of the woven magnetic device on the viewer. By creating a beveled (or biased or cater-cornered or skewed or slanted or transversal) edge of the fingers, the woven magnetic device takes on a three-dimensional appearance which is visually appealing.

The size of the first member 10 and the second member 28 can vary depending upon the desired size of the resulting woven magnetic device. A preferred length of the first member 10 and the second member 28 is about 3.0 inches to about 8.0 inches, with about 3.8 inches to about 4.2 inches preferred. The width of the first member 10 and the second member 28 can be about 2.25 inches to about 5.5 inches, with about 2.5 inches to about 3.0 inches preferred. The length of the fingers can be about 2.0 inches to about 5.5 inches, with about 2.5 inches to about 2.7 inches preferred. The width of the fingers can be about 0.4 inches to about 1.0 inches, with about 0.42 inches to about 0.52 inches preferred.

Figure 8:
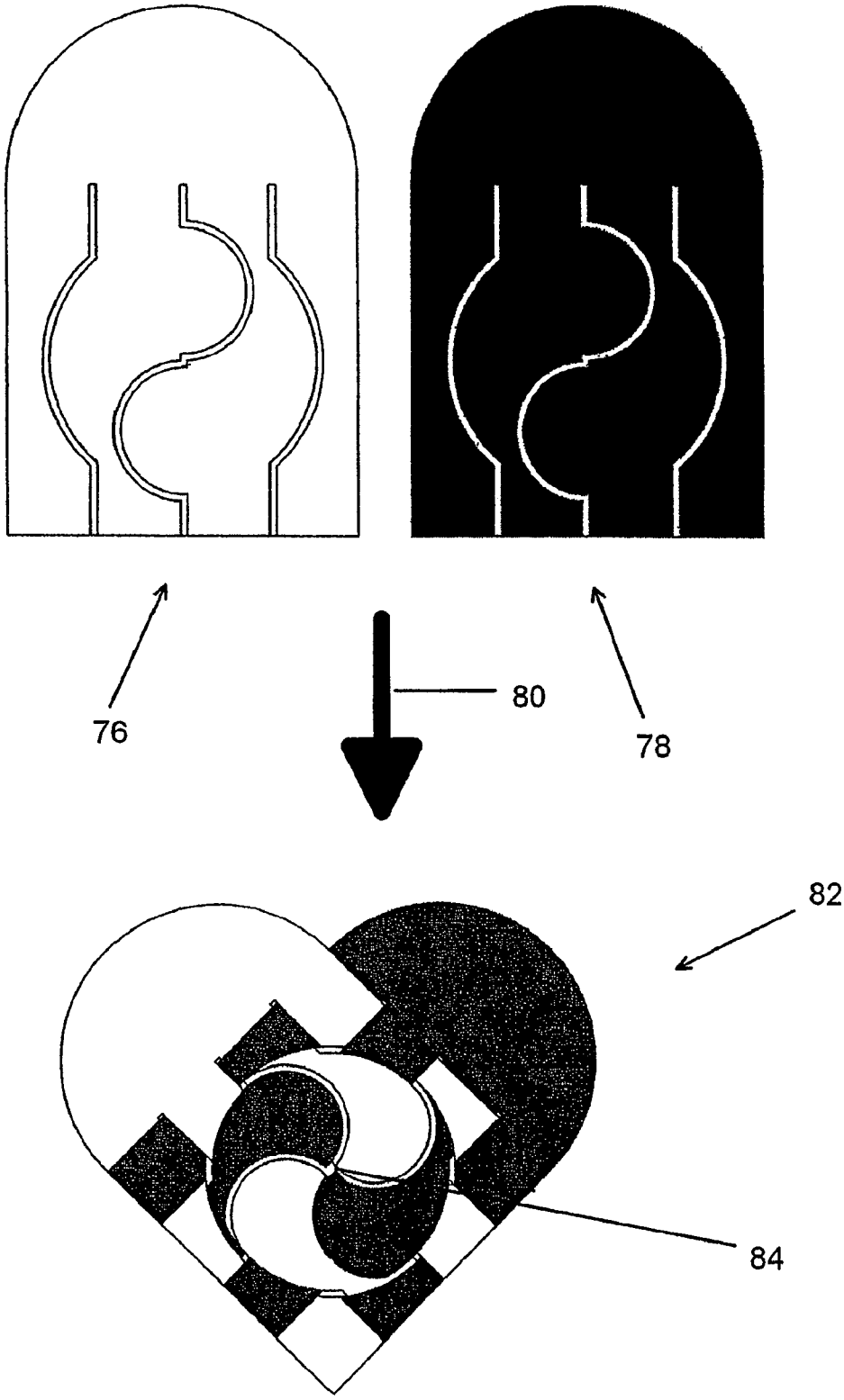
FIG. 8 is a perspective view of two members utilized to create another exemplary embodiment of the woven magnetic device incorporating a design.

When creating designs, as further explained herein, the width of the fingers will vary depending upon the desired design (See FIG. 8).

The first member 10 and the second member 28 comprise a piece of ferromagnetic or ferromagnetic material whose domains are sufficiently aligned so that it produces a net magnetic field outside itself and can experience a net torque when placed in an external magnetic field. The material can be iron, iron alloys, nickel, nickel alloys, cobalt, cobalt alloys, and combinations thereof. The magnetic material can have a thickness of about 0.02 inches to about 0.04 inches, with about 0.025 inches to about 0.035 inches preferred. The thickness of the material is dependent upon the type of material, and the use and size of the woven magnetic device.

Figure 3:
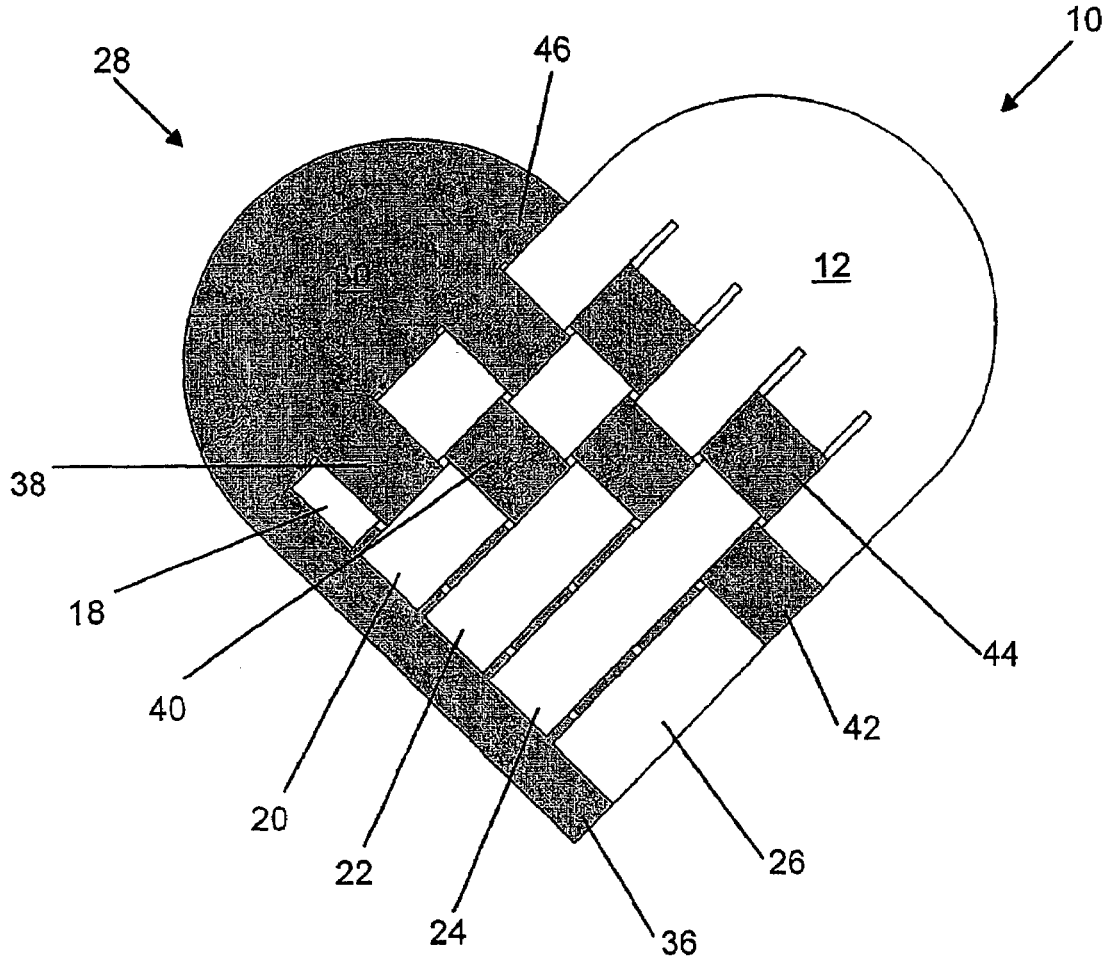
FIG. 3 is a perspective view of the first member being woven with the second member to form an exemplary woven magnetic device.
Figure 4:
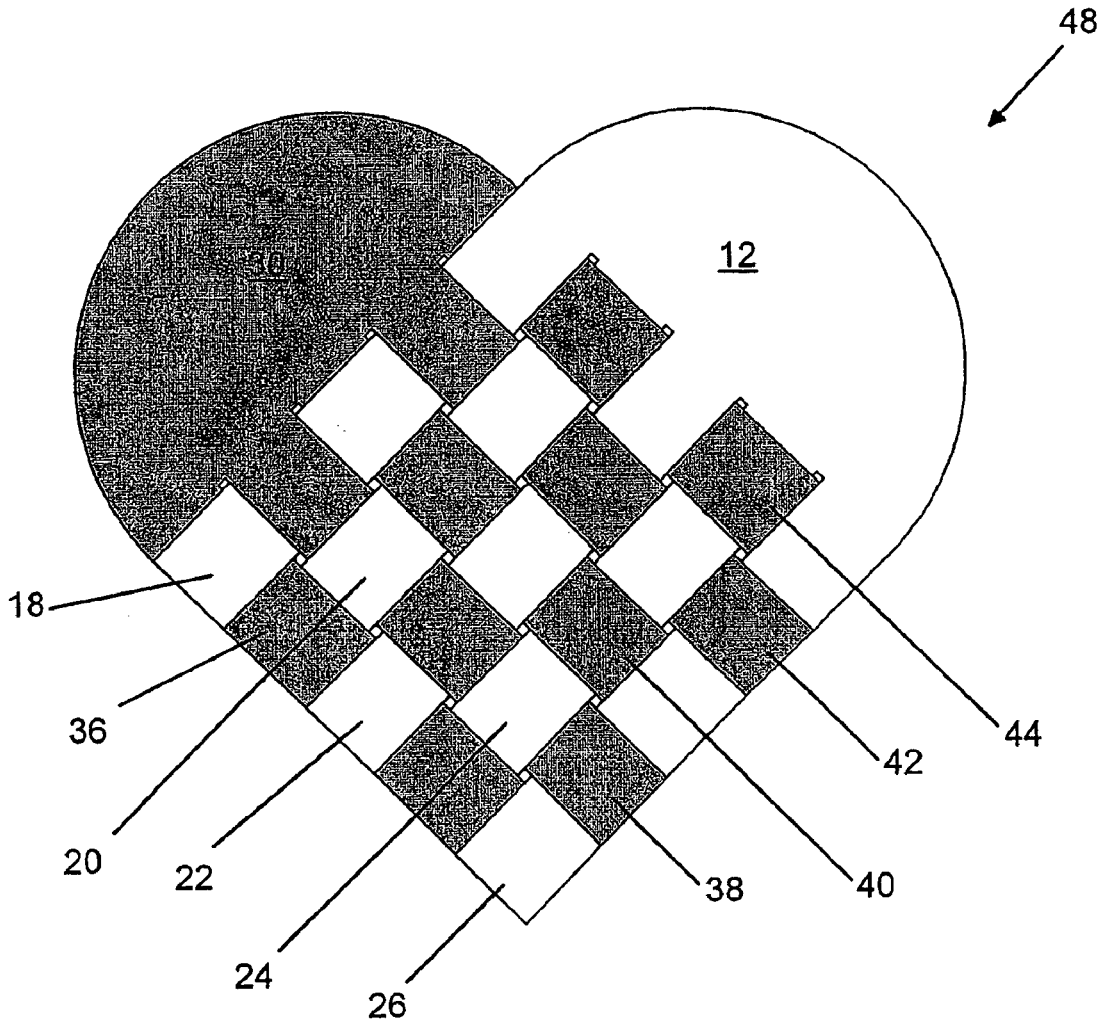
FIG. 4 is a perspective view of an exemplary embodiment of the woven magnetic device.

Referring to FIG. 3, an illustration of the weaving (or braiding or interlacing or lacing or intertwining or plaiting or entwining or merging or uniting or interweaving) of the first member 10 with the second member 28 in order to form an exemplary woven magnetic device is presented. In order to create the woven magnetic device, the first member 10 must be woven with the second member 18. To start, freely movable finger 18 is woven through the fingers 44, 42, 40, 38, 36 of the second member 28. At the base 46 of the fingers 36, 38, 40, 42, 44 of the second member 28, finger 18 of first member 10 is disposed over finger 44 and then under finger 42 and then over finger 40 and then under finger 38 and finally over finger 36. Next, finger 20 is disposed under finger 44 and then over finger 42 and then under finger 40 and then over finger 38 and finally under finger 36. This process is repeated with each remaining finger (i.e., fingers 22, 24, 26) to create a woven pattern as illustrated in the magnetic woven device 48 in FIG. 4. It is not important which member is utilized to start the weaving process, as long as the two members are braided together as described above. No adhesive is necessary to hold the fingers in place since the magnetic material adheres to itself. The first member 10 and the second member 28 are attracted to each other because of the magnetic property of the material and can be removable from each other with little force.

Figure 5:
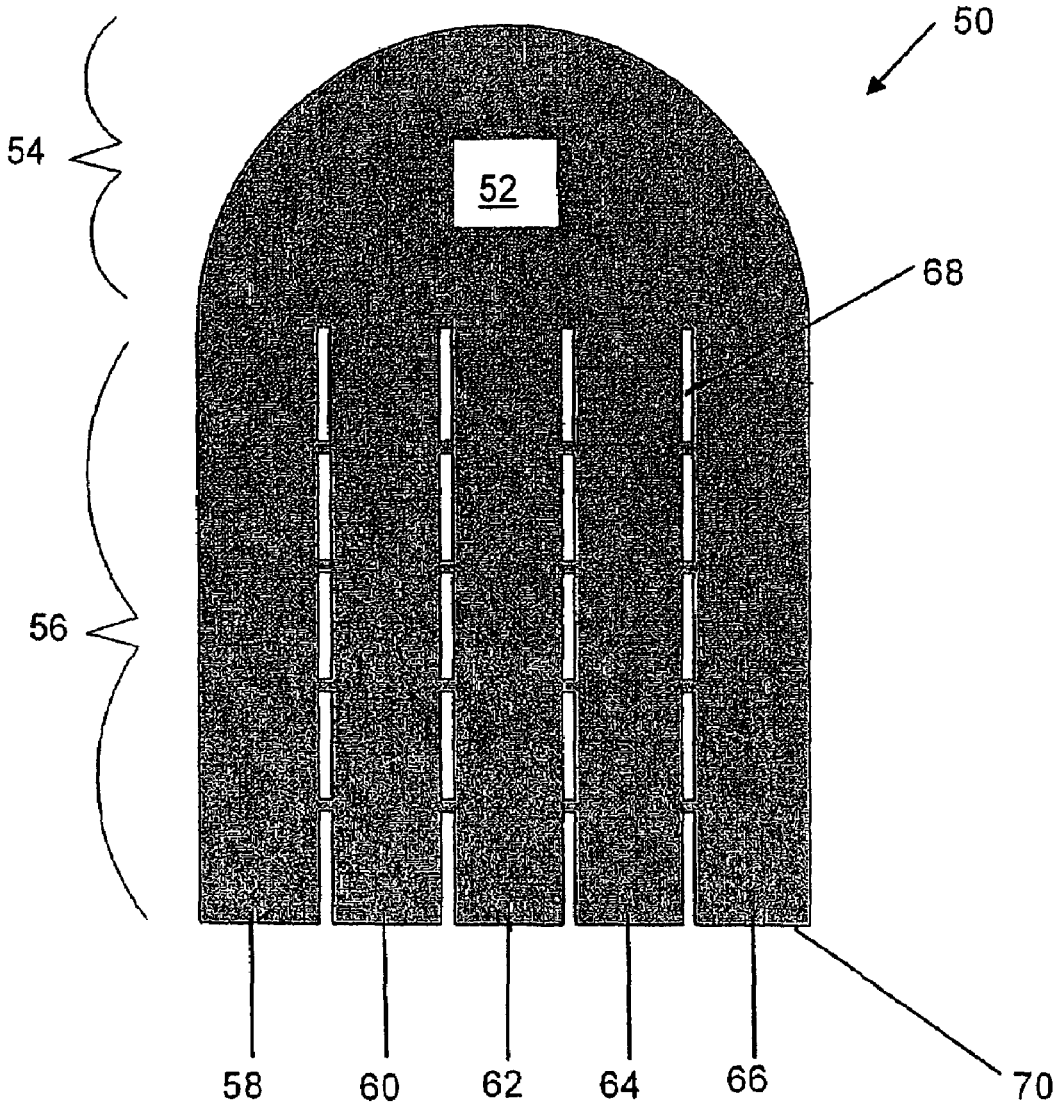
FIG. 5 is a perspective view of a third member of another exemplary woven magnetic device.
Figure 6:
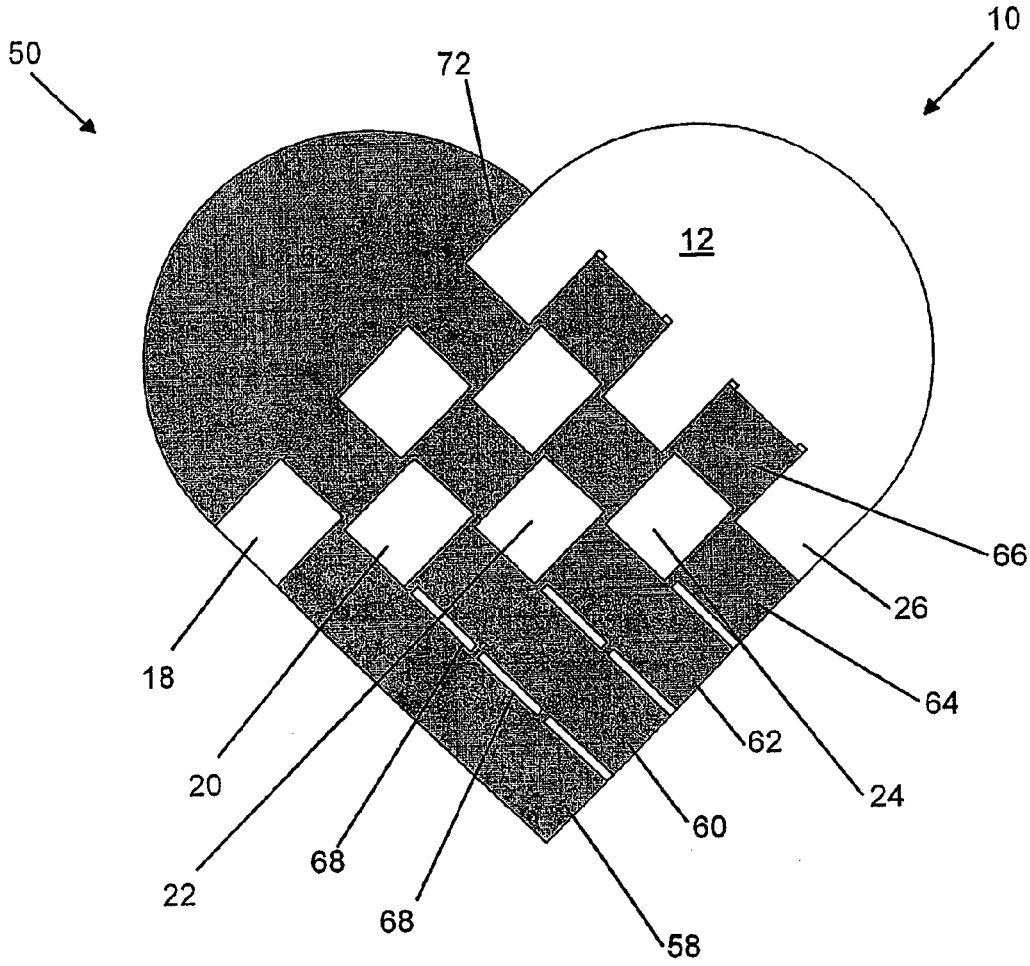
FIG. 6 is a perspective view of the first member of FIG. 1 being woven with the third member to form another exemplary woven magnetic device.
Figure 7:
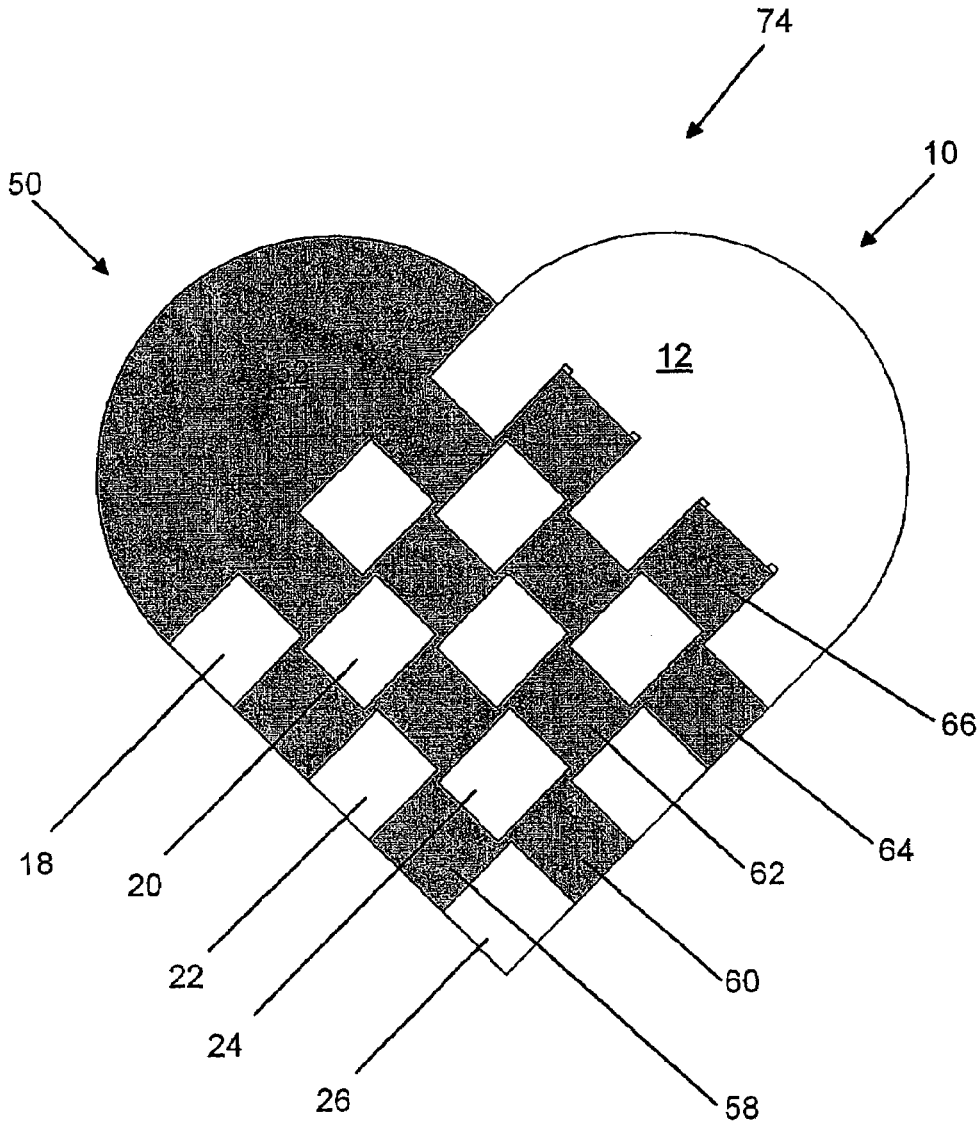
FIG. 7 is a perspective view of another exemplary embodiment of the woven magnetic device.

Another embodiment is illustrated in FIGS. 5, 6, and 7. In FIG. 5, a third member 50 includes a body 52. The third member 50 body 52 has a top portion 54 and a bottom portion 56. The top portion 54 can be of any shape, with a rounded configuration preferred, although other configurations are contemplated, as illustrated and further described in FIG. 8. The bottom portion 56 is configured to have fingers 58, 60, 62, 64, 66. However, the fingers are not freely movable. The fingers are defined by the existence of slots (or openings) 68 disposed vertically along the bottom portion 56 creating interlocking fingers. The slots 68 are of sufficient length and width to receive the fingers of a mating member (i.e., first member 10). The slots 68 disposed at the end 70 of the bottom portion 56 are open for ease in receiving the final finger. The fingers are of equal length and shape. Although five fingers are illustrated, any number of fingers may be utilized depending upon the intricacies of the design desired.

Referring now to FIG. 6, an illustration of the weaving (or braiding) of the first member 10 with the third member 50 in order to form an exemplary woven magnetic device is presented. In order to create the woven magnetic device, the first member 10 must be woven with the third member 50 utilizing the slots 68. To start, finger 18 is woven through the fingers 66, 64, 62, 60, 58 of the third member 50. At the base 72 of the fingers 58, 60, 62, 64, 66 of the third member 50, finger 18 of first member 10 is disposed over finger 66 fed down through the first slot 68 to be under finger 64, then finger 18 is fed up through the next slot 68 and then over finger 62, then finger 18 is fed down through the next slot 68 to be under finger 60 and then finger 18 is fed up through the final slot 68 and positioned over finger 58. Next, finger 20 of first member 10 is disposed under finger 66 and fed up through the first slot 68 to be over finger 64, then finger 18 is fed down through the next slot 68 and then under finger 62, then finger 18 is fed up through the next slot 68 to be over finger 60 and then finger 18 is fed down through the final slot 68 and positioned under finger 58. This process is repeated with each remaining finger (i.e., fingers 22, 24, 26) to create a woven pattern as illustrated in the magnetic woven device 74 in FIG. 7. In each case, when weaving it is ideal to have the two members 10, 50 be of the same shape, with one of the members having slots instead of freely movable fingers. The shape of the members and fingers may vary depending upon the design or pattern desired, as will be discussed further herein. As stated above, no adhesive is necessary to hold the fingers in place since the magnetic material adheres to itself.

As illustrated in FIG. 8, other woven designs are contemplated. The intricacies of the designs are dependent upon the manner of weaving, the number of fingers, the size of the fingers, the colors of the fingers, the designs on the fingers, and the desired pattern. It is contemplated to create curved fingers, fingers having specific shapes (i.e., cut-outs or jutting portions) to create a design or figure (i.e., hearts, stars, trees, crests, faces, people, etc.) within the woven magnetic device. For example, FIG. 8 illustrates a first member 76 and a second member 78 that can be woven as described above (illustrated using arrow 80) to create the woven magnetic device 82 having a design element 84 incorporated therein. In this case, the design element 84 is a pinwheel shape. Any design elements are contemplated as long as the fingers can be shaped to create a specific design.

Figure 9:
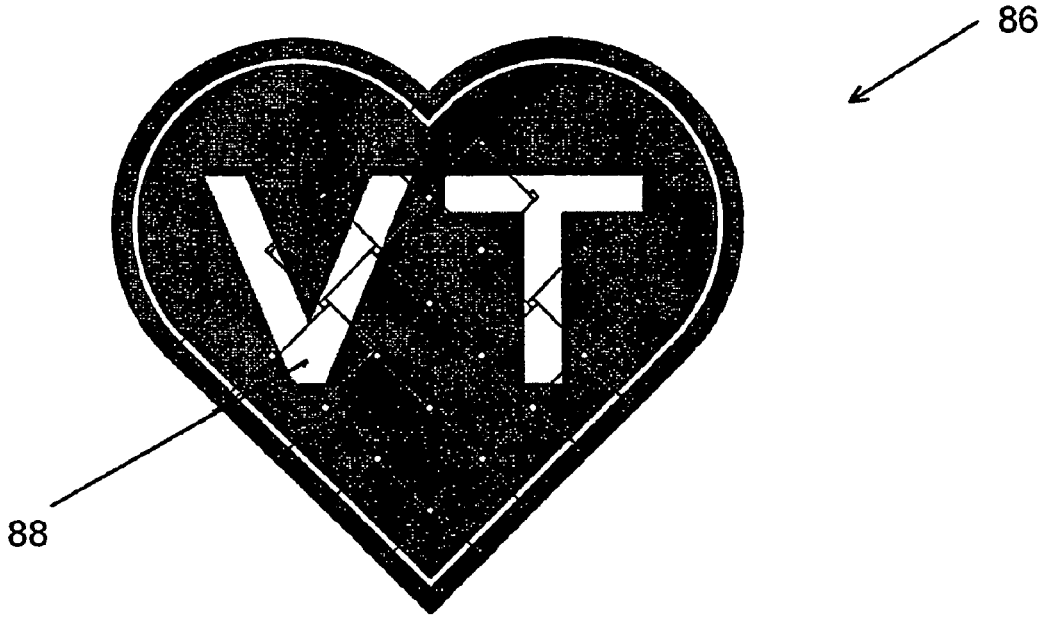
FIG. 9 is a perspective view of another exemplary embodiment of the woven magnetic device incorporating a design.
Figure 10:
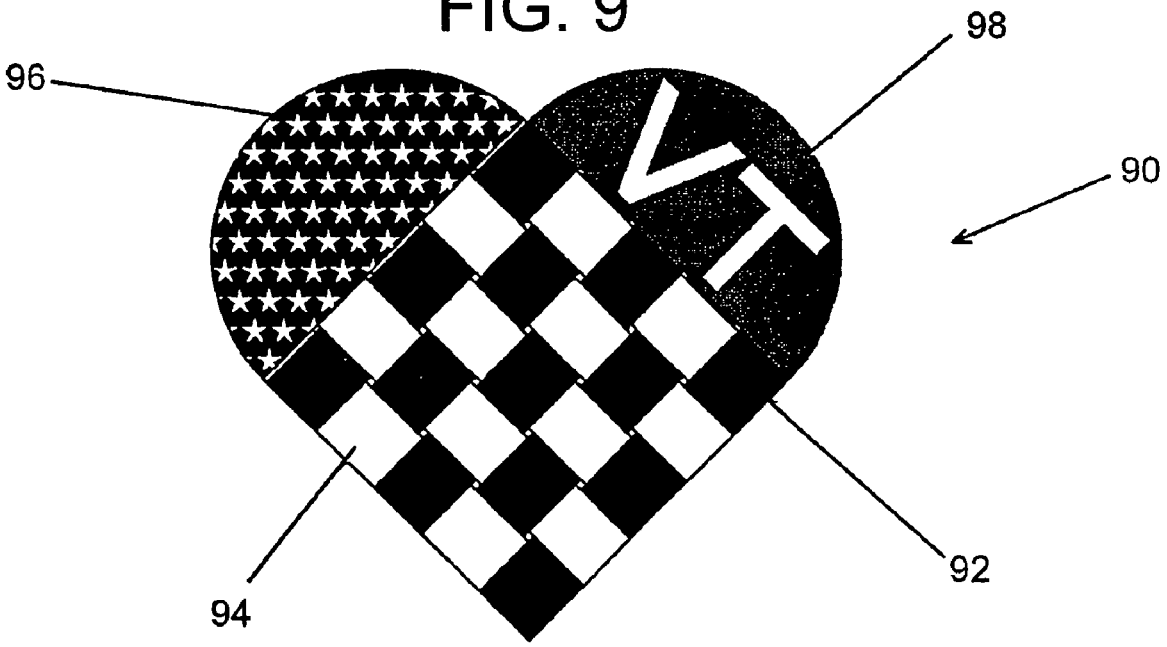
FIG. 10 is a perspective view of another exemplary embodiment of the woven magnetic device incorporating a design.

The members may be of different colors or have graphics disposed on them so as to create a colorful device or a specific design once woven, as illustrated in FIGS. 9 and 10. FIGS. 9 and 10 illustrate the use of graphics. Woven magnetic device 86 is colored green and when woven will display a white VT 88 (i.e., the abbreviation for Vermont). Likewise, magnetic woven device 90 is colored to resemble an American flag (i.e., red, white, and blue) so the red stripes 92 and white stripes 94 are woven together. A first top corner 96 of the magnetic woven device 90 is blue with a design of white stars while the second top corner 98 is green having a white VT. Various resulting graphic designs for the woven magnetic device are contemplated including, but not limited to, flags of countries (i.e., the United States, Denmark, Norway, Sweden, Canada, China, Japan, Germany, the Netherlands, Australia, South Africa, etc.), symbols for favorite destinations (VT, BI, etc.), designs for causes (i.e., "Support Our Troops", the American Heart Association, Downs Syndrome, etc.), advertising for businesses or political candidates, funny sayings, inspirational sayings, driving messages, and messages of love.

The woven magnetic device provides an aesthetically pleasing means for an individual to convey messages to others. The design of the woven magnetic device ensures that the object to which it is applied is not damaged. Further, the properties of the magnetic material lend to the ability of the woven members to adhere to each other.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings without departing from the essential scope thereof. Therefore, it is intended that the invention not be limited to the particular embodiment disclosed as the best mode contemplated for carrying out this invention.

What is claimed is:

1. A magnetic woven device comprising:

a first member comprising a magnetic material and having a body with a top portion and a bottom portion opposite said top portion, said bottom portion having at least two fingers; and a second member comprising a magnetic material and having a body with a top portion and a bottom portion opposite said top portion and said bottom portion having at least two fingers interwoven with said at least two fingers of said first member;

wherein said top portion of said first member and said top portion of said second member are rounded and said bottom portion of said first member and said bottom portion of said second member are rectangular to create a heart shape when woven.

2. The magnetic woven device of claim 1, wherein said at least two fingers have a thickness of about 0.02 inches to about 0.04 inches.

3. The magnetic woven device of claim 1, wherein said at least two fingers of said second member are in physical communication with each other creating at least one slot.

4. The magnetic woven device of claim 1, wherein an element of a design is imprinted on said first member and said second member.

5. The magnetic woven device of claim 1, wherein a design is created by interweaving said first member and said second member.

6. The magnetic woven device of claim 1, wherein said first member and said second member are substantially similar.

7. The magnetic woven device of claim 1, wherein said first member is removably attached to said second member.

8. The magnetic woven device of claim 1, wherein said at least two fingers of said first member and said second member have a beveled edge.

9. A method of making a magnetic woven device comprising:

producing a first member comprising a magnetic material and having a body with a top portion and a bottom portion opposite said top portion, said bottom portion having at least two fingers; and weaving at least two fingers of a second member with said at least two fingers of said first member, said second member comprising a magnetic material and having a body with a top portion and a bottom portion opposite said top portion and said bottom portion having said at least two fingers;

wherein said top portion of said first member and said top portion of said second member are rounded and said bottom portion of said first member and said bottom portion of said second member are rectangular creating a heart shape when woven.

10. The method of claim 9, wherein said at least two fingers have a thickness of about 0.02 inches to about 0.04 inches.

11. The method of claim 9, wherein said at least two fingers of said second member are in physical communication with each other creating at least one slot.

12. The method of claim 9, wherein an element of a design is imprinted on said first member and said second member.

13. The method of claim 9, wherein said weaving creates a design.

14. The method of claim 9, wherein said first member and said second member are substantially similar.

15. The method of claim 9, wherein said weaving disposes of a first of said at least two fingers of said first member under a first of said at least two fingers of said second member followed by disposing said first of said at least two fingers of said first member over a second of said at least two fingers of said second member.

16. The method of claim 9, further comprising:

removably attaching said first member to said second member.

17. The method of claim 9, wherein said at least two fingers of said first member and said second member have a beveled edge.

* * * * *